US009360794B2

(12) United States Patent
Wada et al.

(10) Patent No.: US 9,360,794 B2
(45) Date of Patent: Jun. 7, 2016

(54) DEVELOPING DEVICE AND IMAGE FORMING DEVICE PROVIDED WITH SAME

(71) Applicant: KYOCERA Document Solutions Inc., Osaka (JP)

(72) Inventors: Minoru Wada, Osaka (JP); Masaru Hatano, Osaka (JP); Yoshinori Horiuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/892,864

(22) PCT Filed: Nov. 10, 2014

(86) PCT No.: PCT/JP2014/079725
§ 371 (c)(1),
(2) Date: Nov. 20, 2015

(87) PCT Pub. No.: WO2015/107757
PCT Pub. Date: Jul. 23, 2015

(65) Prior Publication Data

US 2016/0109829 A1 Apr. 21, 2016

(30) Foreign Application Priority Data

Jan. 15, 2014 (JP) ..... 2014-004918

(51) Int. Cl.
*G03G 15/08* (2006.01)
*G03G 15/09* (2006.01)

(52) U.S. Cl.
CPC ..... *G03G 15/0812* (2013.01); *G03G 15/09* (2013.01)

(58) Field of Classification Search
CPC ..... G03G 15/0812; G03G 15/09
USPC ..... 399/274, 284
See application file for complete search history.

(56) References Cited

U.S. PATENT DOCUMENTS 4,637,706 A * 1/1987 Hosoi ..... G03G 15/0914 399/275
5,072,690 A * 12/1991 Ishikawa ..... G03G 15/0921 399/275
7,899,373 B2 * 3/2011 Yamagishi ..... G03G 15/0812 399/275

FOREIGN PATENT DOCUMENTS

JP 07152252 A * 6/1995
JP 2000275962 A * 10/2000

(Continued)

OTHER PUBLICATIONS

International Search Report dated Dec. 22, 2014, issued International Application No. PCT/JP2014/079725.

*Primary Examiner* — Robert Beatty
(74) *Attorney, Agent, or Firm* — Stein IP, LLC

(57) ABSTRACT

Provided is a developing device that can restrain stress on a developer and improve image quality. This developing device (3*a*-3*d*) is provided with: a developing vessel (20) that accommodates the developer, which includes a magnetic carrier and toner; a supply transport screw (23*b*); a developing roller (31) that carries the developer supplied by the supply transport screw (23*b*); an ear cutting blade (32) that regulates layer thickness of the developer on the surface of the developing roller (31); and a magnet (50) magnetized on one surface and disposed on the upstream side of the ear cutting blade (32). The magnet (50) is disposed such that a magnetized surface (50*a*) faces the side of the developing roller (31).

6 Claims, 4 Drawing Sheets

(56) References Cited

FOREIGN PATENT DOCUMENTS

| | | | | |
|---|---|---|---|---|
| JP | 2003167426 | A | * | 6/2003 |
| JP | 2003-255710 | A | | 9/2003 |
| JP | 2009300755 | A | * | 12/2009 |
| JP | 2011112696 | A | * | 6/2011 |
| JP | 2012173506 | A | * | 9/2012 |

* cited by examiner

DEVELOPING DEVICE AND IMAGE FORMING DEVICE PROVIDED WITH SAME

CROSS-REFERENCE TO RELATED APPLICATIONS

This application is a national stage of International Application No. PCT/JP2014/079725, filed Nov. 10, 2014, which claims the benefit of priority to Japanese Application No. 2014-004918, filed Jan. 15, 2014, in the Korean Intellectual Property Office, the disclosures of which are incorporated herein by reference.

TECHNICAL FIELD

The present invention relates to a developing device and to an image forming apparatus incorporating one. More particularly, the present invention relates to a developing device including a regulating member for regulating the layer thickness of developer on the surface of a developer carrying member, and to an image forming apparatus incorporating such a developing device.

BACKGROUND ART

There are conventionally known, as developing devices for developing an electrostatic latent image on a photosensitive member as an image carrying member, those adopting a one-component development method and those adopting a two-component development method. A two-component development method uses developer containing toner and magnetic carrier; this provides a stabile amount of electrostatic charge for a long period, and is suitable to obtain long service lives. For example, in a developing device adopting a two-component development method, developer containing toner and magnetic carrier is stored, and the developer is fed from a stirring member to a developing roller (developer carrying member). The developing roller has a magnet (such as a regulating pole) inside it, and by the action of this magnet (such as a regulating pole), developer is carried in the form of a magnetic brush on the surface of the developing roller. As the developing roller rotates, the developer is transported to a part of the developing roller opposite the photosensitive member. Then, out of the developer, only toner is fed to the photosensitive member, and thereby an electrostatic latent image on the photosensitive member is turned into a visible image as a toner image.

There is also known a developing device comprising a regulating member for regulating the layer thickness of developer to make constant the amount of developer that, as a developing roller rotates, is transported to a part thereof opposite a photosensitive member and a magnet arranged on the upstream side of the regulating member with respect to the rotation direction of the developing roller. As such a developing device, a developing device is known that uses a one-component developer containing magnetic toner (e.g., Patent Document 1 identified below). In this developing device, a magnet is arranged on the upstream side of a regulating member with respect to the rotation direction of a developing roller so that, at a tip part (a developing roller side tip part) of the regulating member, a magnetic pole of the polarity opposite to that of a regulating pole is induced, and thereby the developer passing between the developing roller and the regulating member is regulated to have a predetermined layer thickness.

LIST OF CITATIONS

Patent Literature

Patent Document 1: Japanese Patent Application Publication No. 2003-255710

SUMMARY OF THE INVENTION

Technical Problem

However, if the above-mentioned developing device where a magnet is arranged on the upstream side of a regulating member with respect to the rotation direction of a developing roller is applied as it is to a developing device adopting two-component development, certainly a thin film of developer (a magnetic brush) can be formed stably but, inconveniently, the developer is subject to great stress, resulting in degraded image quality. Specifically, as shown in FIG. 7, in the magnetic field of the magnet 150 arranged on the upstream side (in FIG. 7, the left side) of the regulating member 132 with respect to the rotation direction of the developing roller 131, toner is stirred and transported by a stirring/transporting member 123*b*. Meanwhile, in the magnetic field, while magnetic carrier tends to link together, toner is moved. Thus, the magnetic toner and the toner rub against each other, causing an additive to be embedded in toner or to move from toner to carrier, degrading the toner and the carrier. This results in degraded image quality.

Devised against the background discussed above, the present invention aims to provide a developing device that can suppress stress on developer and thereby improve image quality, and to provide an image forming apparatus incorporating such a developing device.

Means for Solving the Problem

According to one aspect of the present invention, a developing device includes: a developer container for storing developer containing magnetic carrier and toner; a stirring/transporting member for stirring and transporting the developer inside the developer container; a developer carrying member for carrying the developer fed from the stirring/transporting member; a regulating member arranged opposite the developer carrying member, for regulating the layer thickness of the developer on the surface of the developer carrying member; and a magnet arranged on the upstream side of the regulating member with respect to the rotation direction of the developer carrying member, and magnetized on one face with an S pole and an N pole extending in the rotation axis direction of the developer carrying member. Here, the magnet is arranged with its magnetized face facing the developer carrying member.

Advantageous Effects of the Invention

According to the present invention, the magnet magnetized on one face is arranged opposite the developer carrying member with the magnetized face of the magnet facing the developer carrying member. This helps suppress lines of magnetic force emanating from the face of the magnet opposite from the developer carrying member, and thus helps suppress a magnetic field formed by the magnet elsewhere than on the developer carrying member side of the magnet. This helps suppress stress on developer resulting from magnetic carrier and toner rubbing against each other elsewhere than on the developer carrying member side of the magnet, leading to improved image quality.

Further features and advantages of the present disclosure will become apparent from the description of embodiments given below.

DESCRIPTION OF EMBODIMENTS

Hereinafter, an embodiment of the present invention will be described with reference to the accompanying drawings.

With reference to FIGS. 1 to 6, a construction of an image forming apparatus 100 provided with developing devices 3*a* to 3*d* according to one embodiment of the present invention will be described. In the image forming apparatus 100 (here, a color printer), inside its body, four image forming portions Pa, Pb, Pc, and Pd are arranged in this order from the upstream side (in FIG. 1, the right side) with respect to the transport direction. These image forming portions Pa to Pd are provided to correspond to four different colors (cyan, magenta, yellow, and black), and respectively form a cyan, a magenta, a yellow, and a black image sequentially each through the processes of electrostatic charting, light exposure, image development, and image transfer.

Figure 1:
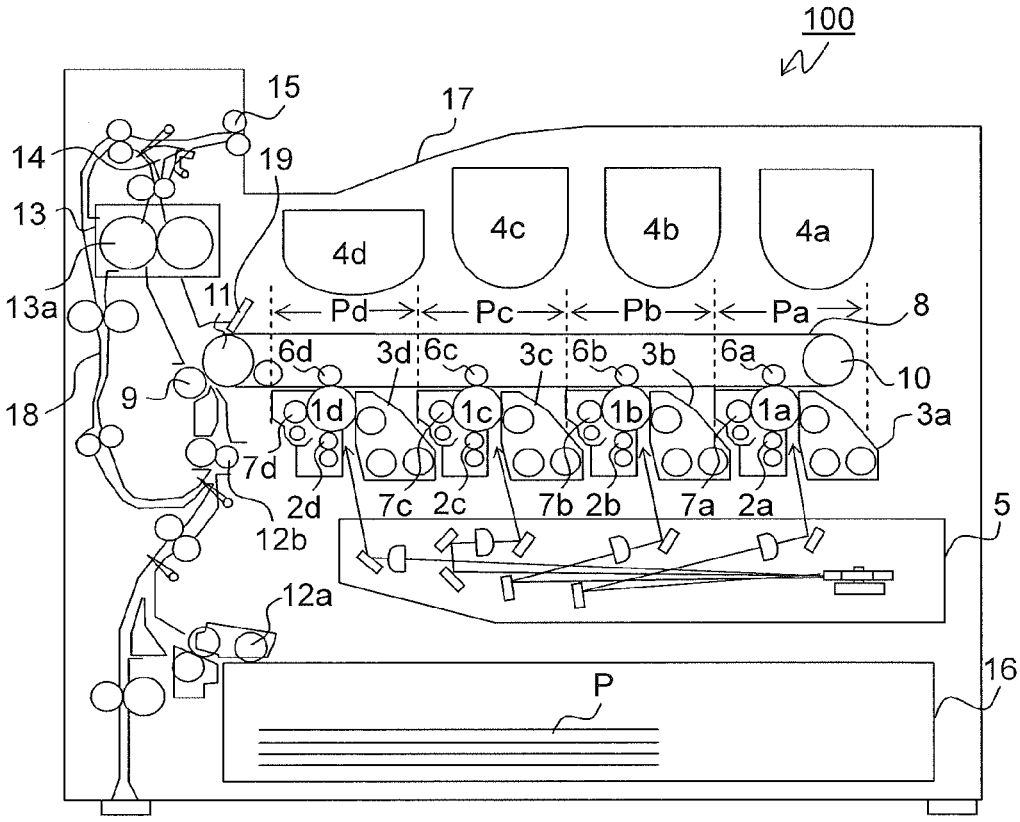
FIG. 1 is a sectional view schematically showing a construction of an image forming apparatus provided with a developing device according to one embodiment of the present invention.

In the image forming portions Pa to Pd, there are arranged photosensitive drums (image carrying members) 1*a*, 1*b*, 1*c*, and 1*d*, respectively, which carry visible images (toner images) of the different colors, and next to the image forming portions Pa to Pd, there is arranged an intermediary transfer belt 8 which is driven by driving means (unillustrated) to rotate clockwise in FIG. 1. The toner images formed on the photosensitive drums 1*a* to 1*d* are primarily transferred to the intermediary transfer belt 8 which moves while being kept in contact with the photosensitive drums 1*a* to 1*d* so as to be superimposed on each other. Thereafter, the toner images transferred to the intermediary transfer belt 8 are secondarily transferred by the action of a secondary transfer roller 9 to transfer paper P as one example of a recording medium. The transfer paper P having the toner images secondarily transferred to it is then, after the toner images are fixed in a fixing portion 13, discharged out of the body of the image forming apparatus 100. While the photosensitive drums 1*a* to 1*d* are rotated counter-clockwise in FIG. 1, an image formation process is performed with respect to each of the photosensitive drums 1*a* to 1*d*.

Transfer paper P, to which toner images are to be secondarily transferred, is contained in a sheet cassette 16 arranged in a lower part of the body of the image forming apparatus 100, and is transported via a sheet feed roller 12*a* and a registration roller pair 12*b* to a nip portion between the secondary transfer roller 9 and a driving roller 11, described later, of the intermediary transfer belt 8. As the intermediary transfer belt 8, a sheet of a dielectric resin is used, and typically it is a belt with no seam (seamless belt). On the downstream side of the secondary transfer roller 9, there is arranged a blade-shaped belt cleaner 19 for removing toner and the like left on the surface of the intermediary transfer belt 8.

Next, the image forming portions Pa to Pd will be described. Around and under the photosensitive drums 1*a* to 1*d*, which are arranged so as to be freely rotatable, there are arranged chargers 2*a*, 2*b*, 2*c*, and 2*d* for electrostatically charging the photosensitive drums 1*a* to 1*d*, an exposing device 5 for exposing the photosensitive drums 1*a* to 1*d* to light carrying image information, developing devices 3*a*, 3*b*, 3*c*, and 3*d* for forming toner images on the photosensitive drums 1*a* to 1*d*, and cleaning portions 7*a*, 7*b*, 7*c*, and 7*d* for removing developer (toner) and the like left on the photosensitive drums 1*a* to 1*d*.

When image data is received from a host device such as a personal computer, first, the chargers 2*a* to 2*d* electrostatically charge the surface of the photosensitive drums 1*a* to 1*d* uniformly, and then the exposing device 5 radiates light according to the image data, so that electrostatic latent images based on the image data are formed on the photosensitive drums 1*a* to 1*d*. The developing devices 3*a* to 3*d* are charged with predetermined amounts of two-component developer containing cyan, magenta, yellow, and black toner respectively. When the proportion of toner in the two-component developer contained in any of the developing devices 3*a* to 3*d* falls below a prescribed value, toner is supplied to the developing device 3*a* to 3*d* from the corresponding one of the toner containers (supplying portions) 4*a* to 4*d*. The toner in the developer is fed by the developing devices 3*a* to 3*d* onto the photosensitive drums 1*a* to 1*d*, and electrostatically attaches to them, and thereby toner images corresponding to the electrostatic latent images formed by exposure to light from the exposing device 5 are formed.

Then, primary transfer rollers 6*a* to 6*d* apply a predetermined transfer voltage between the primary transfer rollers 6*a* to 6*d* and the photosensitive drums 1*a* to 1*d*, so that the cyan, magenta, yellow, and black toner on the photosensitive drums 1*a* to 1*d* is primarily transferred to the intermediary transfer belt 8. These images of four colors are formed in a predetermined positional relationship relative to each other that is prescribed for the formation of a predetermined full-color image. Thereafter, in preparation for the subsequent formation of new electrostatic latent images, the toner and the like left on the surfaces of the photosensitive drums 1*a* to 1*d* after primary transfer are removed by the cleaning portions 7*a*, 7*b*, 7*c*, and 7*d*.

The intermediary transfer belt 8 is wound around and between a driven roller 10 on the upstream side and a driving roller 11 on the downstream side. As the intermediary transfer belt 8 starts to rotate clockwise as a result of the driving roller 11 being rotated by a drive motor (unillustrated), transfer paper P is transferred, with predetermined timing, from the registration roller pair 12*b* to the nip portion (secondary transfer nip portion) between the driving roller 11 and the secondary transfer roller 9 arranged next to it, so that the full-color image on the intermediary transfer belt 8 is secondarily transferred to the transfer paper P. The transfer paper P having the toner images secondarily transferred to it is transported to the fixing portion 13.

The transfer paper P transferred to the fixing portion 13 is heated and pressed by a fixing roller pair 13*a*, so that the toner images are fixed to the surface of the transfer paper P, thereby forming the predetermined full-color image. The transfer paper P having the full-color image formed on it is forwarded in one of different transport directions by a branch portion 14 which branches into a plurality of directions. When an image is formed only on one side of the transfer paper P, the transfer paper P is as it is discharged onto a discharge tray 17 by a discharge roller pair 15.

On the other hand, when images are formed on both sides of the transfer paper P, part of the transfer paper P having passed through the fixing portion 13 is first stuck out of the apparatus from the discharge roller pair 15. Then, after the tail edge of the transfer paper P has passed through the branch portion 14, the discharge roller pair 15 is rotated in the reverse direction, and the branch portion 14 is switched to another transport direction. Now, the transfer paper P is, from its tail edge, forwarded into a sheet transport passage 18, and is transported once again, this time with the image side reversed, to the secondary transfer nip portion. Then, the next toner images formed on the intermediary transfer belt 8 are secondarily transferred to the side of the transfer paper P where no image has been formed yet. The transfer paper P having the toner images secondarily transferred to it is transported to the fixing portion 13, where the toner images are fixed, and is then discharged onto the discharge tray 17.

Figure 2:
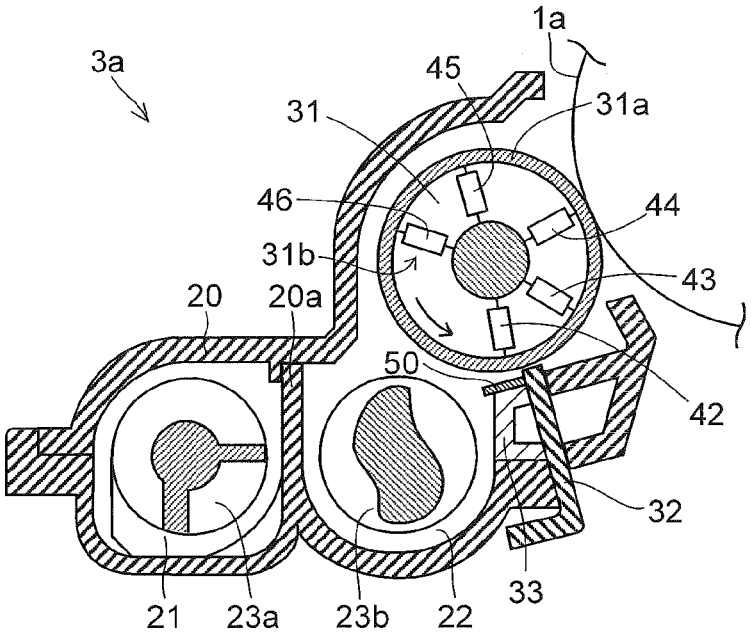
FIG. 2 is a side sectional view showing a structure of a developing device according to one embodiment of the present invention.

Next, with reference to FIG. 2, the structure of the developing device 3*a* will be described in detail. FIG. 2 is a view from behind what is shown in FIG. 1, and the arrangement of the members in the developing device 3*a* in FIG. 2 is the other way around in the left/right direction relative to that in FIG. 1. While the following description deals with the developing device 3*a* arranged in the image forming portion Pa shown in FIG. 1, the developing devices 3*b* to 3*d* arranged in the image forming portions Pb to Pd have basically the same structure, and therefore no overlapping description will be repeated.

As shown in FIG. 2, the developing device 3*a* has a developer container 20 formed of resin for containing two-component developer (hereinafter referred to simply as developer), and the developer container 20 is divided into a stirring/transporting compartment 21 and a feeding/transporting compartment 22 by a partition wall 20*a*. In the stirring/transporting compartment 21 and the feeding/transporting compartment 22, there are rotatably arranged a stirring/transporting screw (stirring/transporting member) 23*a* and a feeding/transporting screw (stirring/transporting member) 23*b*, respectively, for mixing toner (positively charged toner) fed from the toner container 4*a* (see FIG. 1) with carrier, stirring the mixture, and electrostatically charging the toner. The stirring/transporting screw 23*a* transports the developer to one side of a developing roller 31, described later, with respect to its axial direction (the direction perpendicular to the plane of FIG. 2). The feeding/transporting screw 23*b*, while transporting the developer in the opposite direction to the stirring/transporting screw 23*a*, feeds the developer to the developing roller 31.

In opposite end parts, with respect to its length direction (the direction perpendicular to the plane of FIG. 2), of the partition wall 20*a* separating the stirring/transporting compartment 21 and the feeding/transporting compartment 22 from each other, communicating portions (unillustrated) are respectively provided through which the stirring/transporting compartment 21 and the feeding/transporting compartment 22 communicate with each other in their respective end parts.

Thus, the developer is, while being stirred, transported in the axial direction (in the direction perpendicular to the plane of FIG. 2) by the stirring/transporting screw 23*a* and the feeding/transporting screw 23*b* so as to circulate between the stirring/transporting compartment 21 and the feeding/transporting compartment 22 through the communicating portions formed in opposite end parts of the partition wall 20*a*. That is, inside the developer container 20, a circulation path for the developer is formed via the stirring/transporting compartment 21, one communicating portion, the feeding/transporting compartment 22, and the other communicating portion.

The developer container 20 extends obliquely toward the upper right corner of the FIG. 2, and inside the developer container 20, a developing roller (developer carrying member) 31 is arranged over the feeding/transporting screw 23*b*. The developing roller 31 is, at a side thereof facing the opening in the developer container 20 (in FIG. 2, the right side), opposite the photosensitive drum 1*a* and, in this region where the two components are opposite each other, feeds toner to the photosensitive drum 1*a*. The developing roller 31 rotates about its rotation axis in the counter-clockwise direction in FIG. 2.

In the stirring/transporting compartment 21, an unillustrated toner concentration sensor is arranged so as to face the stirring/transporting screw 23*a*, and based on the result of detection by the toner concentration sensor, toner is supplied from the toner container 4*a* via an unillustrated toner supply port into the stirring/transporting compartment 21. As the toner concentration sensor, a magnetic permeability sensor is used which detects the magnetic permeability of the two-component developer containing toner and magnetic carrier in the developer container 20.

The developing roller 31 is composed of a cylindrical non-magnetic developing sleeve 31*a*, which rotates in the counter-clockwise direction in FIG. 2, and a fixed magnet member 31*b* having a plurality of magnetic poles, which is placed inside the developing sleeve 31*a*. In this embodiment, the fixed magnet member 31*b* has the following five magnetic poles; a regulation pole (trim pole) 42, which is an N pole; a transport pole 43, which is an S pole; a main pole 44, which is an N pole; a transport pole 45, which is an S pole; and a separation pole 46, which is an N pole.

Figure 3:
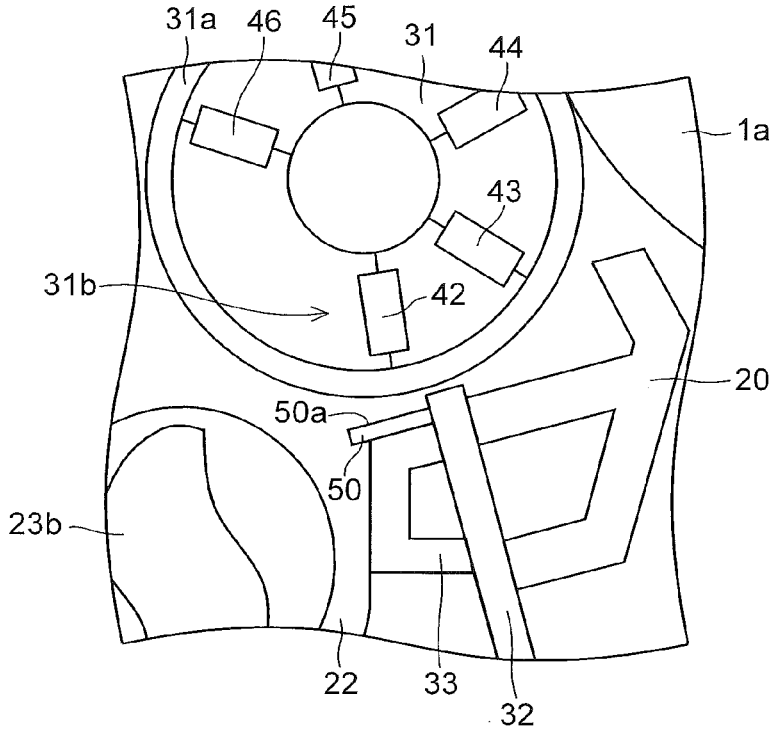
FIG. 3 is an enlarged sectional view showing a structure of and around a regulating pole and a magnet in a developing device according to one embodiment of the present invention.
Figure 4:
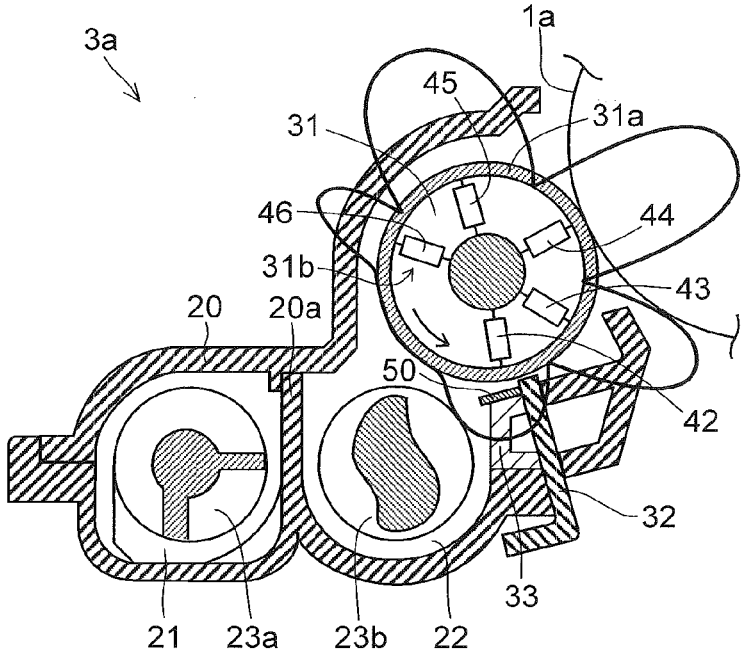
FIG. 4 is a side sectional view showing a magnetic flux distribution of magnetic poles on a developing roller in a developing device according to one embodiment of the present invention.

As shown in FIG. 3, the regulating pole 42 is arranged opposite a trimming blade 32 or a magnet 50, both described later. The magnetic poles of the developing roller 31 have a magnetic flux distribution as shown in FIG. 4. The magnetic force of the regulating pole 42 expands to reach the upstream side of the magnet 50, described later, with respect to the rotation direction of the developing roller 31 (hereinafter referred to simply as the upstream side), and the regulating pole 42 functions also as a pump-up pole for pumping up developer from the feeding/transporting screw 23*b* to the developing roller 31. The regulation pole 42 has a magnetic force of 35 mT, and the main pole 44 has a magnetic force of 100 mT. In FIG. 4, the magnetic flux distribution is indicated by thick lines.

The developer container 20 is fitted with, along the length direction of the developing roller 31 (the direction perpendicular to the plane of FIG. 2), a trimming blade (regulating member) 32 which regulates the thickness of the developer carried on the developing roller 31. The trimming blade 32 is located on the upstream side of the position where the developing roller 31 and the photosensitive drum 1*a* are opposite each other with respect to the rotation direction (in FIG. 2, the counter-clockwise direction) of the developing roller 31. Between a tip part of the trimming blade 32 and the surface of the developing roller 31, a small interval (gap) is left.

The trimming blade 32 is formed of a magnetic material (such as SUS430), and is formed to have a thickness of about 1.5 mm. The trimming blade 32 is fixed to a bottom part of the developer container 20. On the upstream side of the trimming blade 32, a regulation upstream member 33 is arranged. The regulation upstream member 33 has a pre-regulating function, for regulating the thickness of the developer carried on the developing roller 31 to a certain degree prior to its being regulated by the trimming blade 32, and a stress reducing function, for reducing stress on the developer As shown in FIG. 3, on the upstream side of a tip part (a developing roller 31 side part) of the trimming blade 32 (a part thereof facing the developing roller 31), a magnet 50 is arranged which is, for example, a magnet sheet with a thickness of about 0.6 mm. The magnet 50 is fixed to the top face of the regulation upstream member 33.

Figure 5:
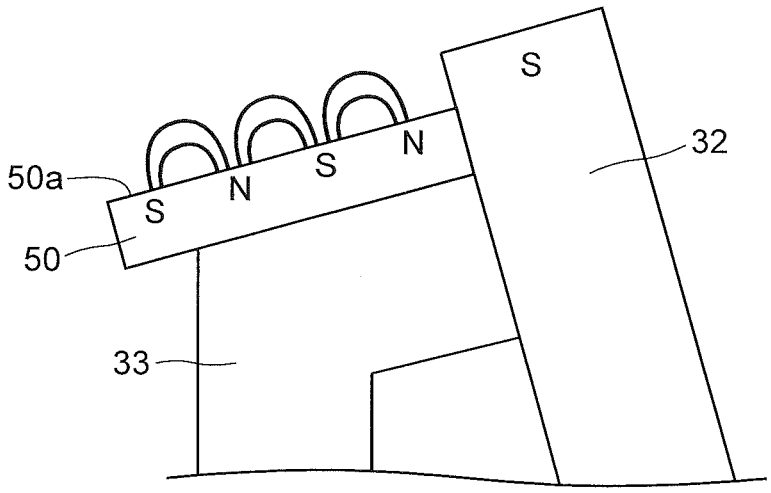
FIG. 5 is an enlarged sectional view illustrating a structure of a magnet in a developing device according to one embodiment of the present invention.

As shown in FIG. 5, a downstream-side end part (a trimming blade 32 side end part) of the magnet 50 is magnetized with an N pole, and thus it induces an S pole in a tip end part (a developing roller 31 side end part) of the trimming blade 32. Accordingly, a magnetic field is produced between the tip end part of the trimming blade 32 and the developing sleeve 31*a* (regulation pole 42), and this gives a predetermined layer thickness to the developer that passes between the trimming blade 32 and the developing roller 31. In FIG. 5, the lines of magnetic force of the magnet 50 are indicated by thick lines.

With the magnetic field between the magnet 50 and the developing roller 31, the developer on the surface of the developing roller 31 is uniformized. This helps suppress uneven density in phase with the rotation pitch of the feeding/transporting screw 23*b*.

Figure 6:
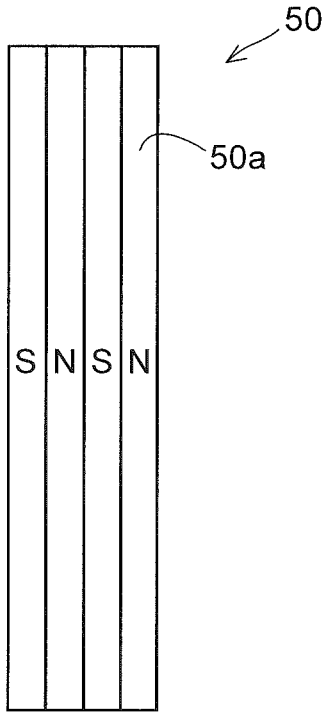
FIG. 6 is an enlarged plan view illustrating a structure of a magnet in a developing device according to one embodiment of the present invention.
Figure 7:
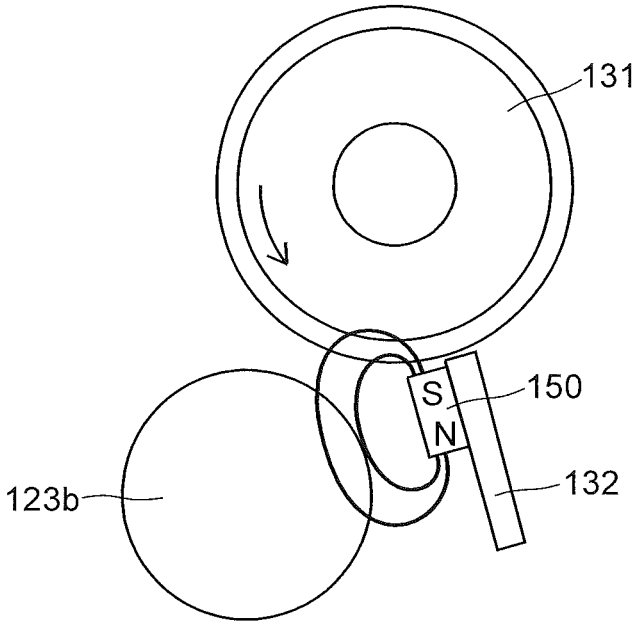
FIG.7 PRIOR ART
FIG. 7 is a sectional view showing one example of a conventional developing device in which a magnet is arranged on the upstream side of a regulating member with respect to the rotation direction of a developing roller.

The magnet 50 is magnetized only on one face (magnetized face 50*a*), and no lines of magnetic force emanate from the face (non-magnetized face) of the magnet 50 opposite from the magnetized face 50*a*. The magnet 50 is arranged opposite the developing roller 31 with the magnetized face 50*a* facing the developing roller 31. The magnetized face 50*a* is magnetized with two pairs of N and S poles at a pitch of about 2.0 mm in a direction along the rotation direction of the developing roller 31. As shown in FIG. 6, the N and S poles extend in the rotation axis direction of the developing roller 31 (the direction perpendicular to the plane of FIG. 2; the up/down direction in FIG. 6). The magnet 50 has a magnetic force of 40 mT. The magnet 50 has only to be magnetized with at least one pair of N and S poles.

The feeding/transporting screw 23*b* described above is arranged in the vicinity of the magnet 50. In other words, the distance from the magnet 50 to the feeding/transporting screw 23*b* is approximately equal to the distance from the magnet 50 to the regulation pole 42. Here, the vicinity of the magnet 50 is within a distance L of the magnet 50, L representing the distance over which the magnet 50 exerts a magnetic force (e.g., the distance from the magnet 50 to the regulation pole 42).

A direct-current voltage (hereinafter referred to as Vslv (DC)) and an alternating-current voltage (hereinafter referred to as Vslv(AC)) are applied to the developing roller 31. These DC and AC voltages are applied to the developing roller 31 from a developing bias power supply via a bias control circuit (neither illustrated).

As mentioned previously, the stirring/transporting screw 23*a* and the feeding/transporting screw 23*b* circulate the developer, while stirring it, through the stirring/transporting compartment 21 and the feeding/transporting compartment 22 inside the developer container 20, thereby electrostatically charging the toner in the developer. The developer inside the feeding/transporting compartment 22 is transported by the feeding/transporting screw 23*b* to the developing roller 31. Then, on the developing roller 31, a magnetic brush (unillustrated) is formed. The magnetic brush on the developing roller 31 has its thickness regulated by the trimming blade 32 and the regulation pole 42, and is then transported, by the rotation of the developing roller 31, to where the developing roller 31 and the photosensitive drum 1*a* is opposite each other. Due to Vslv(DC) an Vslv(AC) being applied to the developing roller 31, the potential difference from the photosensitive drum 1*a* causes toner to fly from the developing roller 31 to the photosensitive drum 1*a*, and thereby the electrostatic latent image on the photosensitive drum 1*a* is developed.

The toner left unused after development is transported on by the rotation of the developing sleeve 31*a*, and the developer on the surface of the developing sleeve 31*a* is given a repellent magnetic pole by the separation pole 46 and the regulation pole 42, the two poles having the same polarity. Thus, around the midpoint between the separation pole 46 and the regulation pole 42, the developer is separated front developing sleeve 31*a*, and drops into the feeding/transporting compartment 22. The developer is then stirred and transported by the stirring/transporting screw 23*a* and the feeding/transporting screw 23*b*; then as a two-component developer that has an adequate toner concentration and that is electrostatically charged uniformly, the developer once again forms a magnetic brush on the developing sleeve 31*a* by the action of the pump-up pole (regulation pole 42), and is then transported to the trimming blade 32.

In this embodiment, as described above, the magnet 50 is arranged opposite the developing roller 31 with the magnetized face 50*a* facing the developing roller 31. This helps suppress lines of magnetic force emanating from the face of the magnet 50 opposite from the developing roller 31, and thus helps suppress a magnetic field formed by the magnet 50 elsewhere than on the developing roller 31 side of the magnet 50. This helps suppress stress on the developer resulting from magnetic carrier and toner rubbing against each other elsewhere than on the developing roller 31 side of the magnet 50 around it, leading to improved image quality. In a magnetic field, magnetic carrier tends to link together; thus, when toner is moved in magnetic carrier, they rub against each other. This causes an additive to be embedded in toner or to move from toner to carrier, leading to degraded image quality.

Moreover, as described above, the feeding/transporting screw 23*b* is arranged in the upstream-side vicinity of the magnet 50. In this case, if lines of magnetic force emanate also from the face of the magnet 50 opposite from the developing roller 31, a magnetic field is formed also in the upstream-side vicinity of the magnet 50. Thus, toner is moved in the magnetic field by the feeding/transporting screw 23*b*, and this makes the developer particularly susceptible to stress. Thus, in a case where the feeding/transporting screw 23*b* is arranged in the upstream-side vicinity of the magnet 50, it is especially effective to apply the present invention.

Moreover, as described above, in the developing device 3*a* where the regulation pole 42 also serves to pump up developer from the feeding/transporting screw 23*b* to the developing roller 31, the magnetic field by the regulation pole 42 expands to reach the feeding/transporting screw 23*b*, and this makes the developer susceptible to stress. Thus, in a case were the regulation pole 42 serves also to pump up developer, it is especially effective to apply the present invention.

Moreover, as described above, the magnetic force of the regulation pole 42 expands to reach the upstream side of the magnet 50. This makes it easy to pump up, with the regulation pole 42, developer from the feeding/transporting screw 23*b* to the developing roller 31.

Moreover, as described above, the magnetized face 50*a* of the magnet 50 is magnetized with two pairs of S and N poles alternately in a direction along the rotation direction of the developing roller 31. This, compared with the magnetized face 50*a* being magnetized with one pair of S and N poles, permits the developer on the surface of the developing roller 31 to be made more uniform by the magnetic field between the magnet 50 and the developing roller 31, and thus helps suppress uneven density in phase with the pitch of the feeding/transporting screw 23*b*.

It should be understood that the embodiment described above is in every aspect merely illustrative and not restrictive. The scope of the present invention is defined not by the description of the embodiment given above but by the appended claims, and encompasses any modifications made in the spirit and scope equivalent to those of the claims.

For example, although the embodiment deals with a case where the present invention is applied to a tandem-type color image forming apparatus as shown in FIG. 1, this is not meant to limit the present invention. Needless to say, the present invention finds applications in a variety of image forming apparatuses, such as monochrome copiers, monochrome printers, digital multifunction peripherals, and facsimile machines, that incorporate a developing device including a regulating member for regulating the layer thickness of the surface of a developer carrying member.

Although the embodiment described above deals with an example where a developing roller is provided as the developer carrying member, this is not meant to limit the present invention; as the developer carrying member, a magnetic roller can be provided between the stirring/transporting member and the developing roller.

Although the embodiment described above deals with an example where the feeding/transporting screw and the regulating member are arranged under the developing roller, this is not meant to limit the present invention; the feeding/transporting screw and the regulating member can be arranged over, or by the side of, the developing roller.

Although the embodiment described above deals with an example where a regulating member formed of a magnetic material is used, this is not meant to limit the present invention; a regulating member composed of a magnet can instead be used.

Any appropriate combination of one or more features from the embodiment described above and from any modified example falls within the technical scope of the present invention.

The invention claimed is:

1. A developing device comprising:

a developer container for storing developer containing magnetic carrier and toner;

a stirring/transporting member for stirring and transporting the developer inside the developer container;

a developer carrying member for carrying the developer fed from the stirring/transporting member;

a regulating member arranged opposite the developer carrying member, for regulating a layer thickness of the developer on a surface of the developer carrying member; and a magnet arranged on an upstream side of the regulating member with respect to a rotation direction of the developer carrying member, the magnet being magnetized on only one face with an S pole and an N pole extending in a rotation axis direction of the developer carrying member, wherein the magnet is arranged opposite the developer carrying member with a magnetized face of the magnet facing the developer carrying member.

2. The developing device of claim 1, wherein the stirring/transporting member is arranged in an upstream-side vicinity of the magnet with respect to the rotation direction of the developer carrying member.

3. The developing device of claim 2, wherein the developer carrying member includes a regulating pole arranged opposite the regulating member or the magnet, and the regulating pole serves also to pump up the developer from the stirring/transporting member to the developer carrying member.

4. The developing device of claim 3, wherein a magnetic force of the regulating pole expands to reach an upstream side of the magnet with respect to the rotation direction of the developer carrying member.

5. The developing device of claim 1, wherein the magnetized face of the magnet is magnetized with two or more pairs of S and N poles alternately in a direction along the rotation direction of the developer carrying member.

6. An image forming apparatus comprising the developing device of claim 1.

* * * * *